US010026356B2

(12) United States Patent
Kim

(10) Patent No.: US 10,026,356 B2
(45) Date of Patent: Jul. 17, 2018

(54) ORGANIC LIGHT EMITTING DISPLAY AND DRIVING METHOD THEREOF

(71) Applicant: Samsung Display Co., Ltd., Yongin, Gyeonggi-do (KR)

(72) Inventor: Do-Ik Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 219 days.

(21) Appl. No.: 14/589,952

(22) Filed: Jan. 5, 2015

(65) Prior Publication Data

US 2015/0243207 A1 Aug. 27, 2015

(30) Foreign Application Priority Data

Feb. 24, 2014 (KR) ..... 10-2014-0021195

(51) Int. Cl.
*G09G 3/30* (2006.01)
*G09G 3/3208* (2016.01)
*G09G 3/20* (2006.01)

(52) U.S. Cl.
CPC ..... *G09G 3/3208* (2013.01); *G09G 3/2029* (2013.01); *G09G 2310/0213* (2013.01); *G09G 2310/0218* (2013.01); *G09G 2330/021* (2013.01)

(58) Field of Classification Search
CPC ..... G09G 3/3258; G09G 3/2029; G09G 2310/0213; G09G 3/2022
USPC ..... 345/76
See application file for complete search history.

(56) References Cited

U.S. PATENT DOCUMENTS 5,969,713 A 10/1999 Tomizawa et al.
6,788,282 B2 * 9/2004 Ito ..... G09G 3/3648 345/103
6,924,824 B2 * 8/2005 Adachi ..... G09G 3/20 315/169.3

(Continued)

FOREIGN PATENT DOCUMENTS

CN 1147123 A 4/1997
CN 1181148 A 5/1998

(Continued)

OTHER PUBLICATIONS

EPO Search Report dated Jun. 22, 2015, for corresponding European Patent application 15156131.3, (8 pages).

(Continued)

*Primary Examiner* — Yuzhen Shen
(74) *Attorney, Agent, or Firm* — Lewis Roca Rothgerber Christie LLP

(57) ABSTRACT

An organic light emitting display and a driving method of the organic light emitting display capable of reducing or minimizing power consumption. The driving method includes setting a number of selection times constituting one frame, and setting a number of unit times constituting the one frame. Each of the unit times includes j (j is a natural number of 2 or more) of the selection times. Scan signals are non-sequentially supplied to scan lines during each of the unit times. The one frame includes a number of subframes. Data signals for ones of the subframes having a same length are supplied corresponding to i (i is a natural number of 2 or more) consecutive ones of the scan signals.

17 Claims, 4 Drawing Sheets

(56) References Cited

U.S. PATENT DOCUMENTS

| | | | | |
|---|---|---|---|---|
| 2003/0197667 | A1* | 10/2003 | Numao | G09G 3/2029 345/82 |
| 2004/0160527 | A1 | 8/2004 | Correa et al. | |
| 2005/0046619 | A1* | 3/2005 | Senda | G09G 3/3283 345/76 |
| 2007/0002082 | A1* | 1/2007 | Sakurai | G09G 3/3648 345/691 |
| 2008/0055206 | A1 | 3/2008 | Ryu et al. | |
| 2008/0191977 | A1* | 8/2008 | Park | G09G 3/2022 345/82 |

FOREIGN PATENT DOCUMENTS

| | | | |
|---|---|---|---|
| CN | 1320900 | A | 11/2001 |
| CN | 1385826 | A | 12/2002 |
| CN | 1426045 | A | 6/2003 |
| CN | 1450511 | A | 10/2003 |
| CN | 101286295 | A | 10/2008 |
| JP | 2853998 | | 2/1999 |
| JP | 2003-216106 | | 7/2003 |
| KR | 10-0805609 | B1 | 2/2008 |

OTHER PUBLICATIONS

Tagawa, A. et al., A Novel Digital-Gray-Scale Driving Method with a Multiple Addressing Sequence for AM-OLED Displays, IDW '04, pp. 279-282, Display Technology Development Group, Sharp Corporation.

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application No. 10-2014-0021195, filed on Feb. 24, 2014 in the Korean Intellectual Property Office, the entire contents of which are incorporated herein by reference.

BACKGROUND

1. Field

Aspects of embodiments of the present invention relate to an organic light emitting display and a driving method of the organic light emitting display.

2. Description of the Related Art

With the development of information technologies, the importance of a display device that serves as a connection medium between a user and information increases. Accordingly, flat panel displays (FPDs) such as liquid crystal displays (LCDs), organic light emitting display devices, and plasma display panels (PDPs) are increasingly used. Among these FPDs, the organic light emitting display devices display images using organic light emitting diodes (OLEDs) that emit light through recombination of electrons and holes. Organic light emitting display devices have a fast response speed and are driven with low power consumption.

SUMMARY

Embodiments of the present invention provide for an organic light emitting display device that can reduce or minimize power consumption, and a driving method of the organic light emitting display device that can reduce or minimize power consumption.

According to an embodiment of the present invention, a method of driving an organic light emitting display is provided. The method includes setting a number of selection times constituting one frame, and setting a number of unit times constituting the one frame. Each of the unit times includes j (j is a natural number of 2 or more) of the selection times. Scan signals are non-sequentially supplied to scan lines during each of the unit times. The one frame includes a number of subframes. Data signals for ones of the subframes having a same length are supplied corresponding to i (i is a natural number of 2 or more) consecutive ones of the scan signals.

Data signals for ones of the subframes having two or more lengths may be supplied during each of the unit times.

Each of the selection times may be a time when one of the scan signals is supplied to one of the scan lines.

The number of selection times constituting the one frame may equal the number of subframes constituting the one frame times a number of the scan lines.

j may be the number of subframes constituting the one frame.

i may be smaller than j.

Ones of the scan lines corresponding to the i consecutive ones of the scan signals may be adjacent to each other.

Ones of the scan lines corresponding to the i consecutive ones of the scan signals may be spaced apart from each other by a number of the scan lines divided by i.

The subframes constituting the one frame may have two or more lengths. Data signals for the subframes having all of the lengths may be supplied during i consecutive ones of the unit times.

Each of the data signals may be a first data signal corresponding to emission of a pixel or a second data signal corresponding to non-emission of the pixel.

According to another embodiment of the present invention, an organic light emitting display in which one frame includes j (j is a natural number of 2 or more) subframes is provided. The organic light emitting display has unit times each including j selection times when scan signals are supplied. The organic light emitting display includes pixels at crossing regions of scan lines and data lines, a scan driver configured to non-sequentially supply the scan signals to the scan lines for each of the unit times, and a data driver configured to supply data signals to the data lines for ones of the subframes having a same length, corresponding to i (i is a natural number of 2 or more) consecutive ones of the scan signals.

The data driver may be further configured to supply data signals for ones of the subframes having two or more lengths during each of the unit times.

A number of the selection times constituting the one frame may equal the number of the scan lines times j.

i may be smaller than j.

Ones of the scan lines corresponding to the i consecutive ones of the scan signals may be adjacent to each other.

Ones of the scan lines corresponding to the i consecutive ones of the scan signals may be spaced apart from each other by a number of the scan lines divided by i.

Each of the data signals may be a first data signal corresponding to emission of one of the pixels or a second data signal corresponding to non-emission of the one of the pixels.

BRIEF DESCRIPTION OF THE DRAWINGS

Example embodiments will now be described more fully hereinafter with reference to the accompanying drawings; however, the present invention may be embodied in different forms and should not be construed as limited to the embodiments set forth herein. Rather, these embodiments are provided to more fully convey the scope of the present invention to those skilled in the art.

In the drawings, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
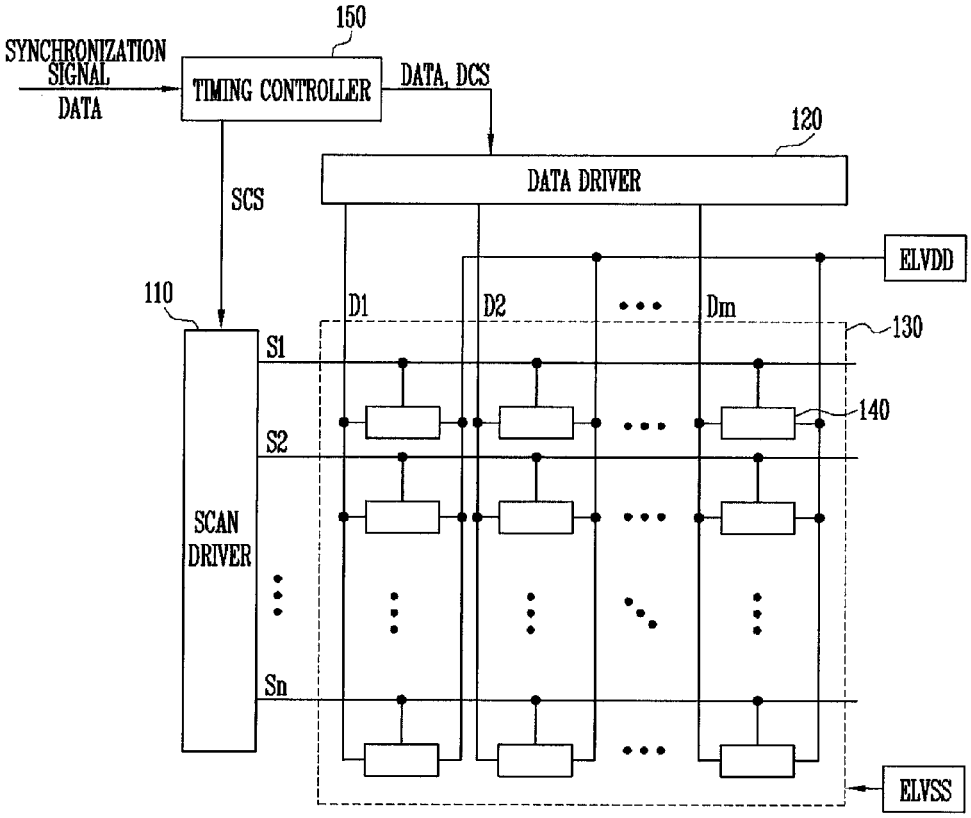
FIG. 1 is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via one or more third elements. Further, some of the elements that are not essential to a complete understanding of the present invention may be omitted for clarity. In addition, like reference numerals refer to like elements throughout.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

FIG. 1 is a diagram illustrating an organic light emitting display according to an embodiment of the present invention.

Referring to FIG. 1, the organic light emitting display includes a display unit 130 that includes pixels 140 respectively positioned in areas (e.g., crossing regions) defined by scan lines S1 to Sn and data lines D1 to Dm, a scan driver 110 configured to drive the scan lines S1 to Sn, a data driver 120 configured to drive the data lines D1 to Dm, and a timing controller 150 configured to control the scan driver 110 and the data driver 120.

The timing controller 150 generates scan driving control signals SCS and data driving control signals DCS corresponding to synchronization signals supplied from outside thereof. The scan driving control signals SCS generated in the timing controller 150 are supplied to the scan driver 110, and the data driving control signals DCS generated in the timing controller 150 are supplied to the data driver 120. The timing controller 150 transfers data supplied from the outside to the data driver 120. Here, the timing controller 150 may store the data in a storage unit and then supply the stored data to the data driver 120, corresponding to a driving method.

The scan driver 110 supplies a scan signal to the scan lines S1 to Sn, corresponding to the scan driving control signals SCS. Here, the scan driver 110 non-sequentially supplies a scan signal to the scan lines S1 to Sn for each of a number of subframe periods (or subframes) of a frame period (or frame), corresponding to the driving method according to embodiments of the present invention to be described later. If the scan signal is supplied to any one of the scan lines S1 to Sn, pixels 140 positioned on a corresponding horizontal line (such as the corresponding pixels 140 receiving the scan signal from the one of the scan lines S1 to Sn) are selected.

The data driver 120 supplies data signals to the data lines D1 to Dm, corresponding to the data driving control signals DCS to supply the data signals to the corresponding pixels 140 on the selected horizontal line. For example, for a particular subframe period, when a corresponding pixel 140 emits light, corresponding to the scan signal (e.g., concurrently or simultaneously supplied with the scan signal), the data driver 120 may supply a first data signal (emission data signal). When the corresponding pixel 140 does not emit light, the data driver 120 may instead supply a second data signal (non-emission data signal) different from the first data signal. That is, the organic light emitting display is driven by a digital driving method, and the first data signal corresponding to the emission of the pixel 140 or the second data signal corresponding to the non-emission of the pixel 140 are supplied as the data signals for each of a plurality of subframe periods for each selected horizontal line.

Additionally, according to embodiments of the present invention, the data driver 120 supplies data signals for subframe periods having different lengths (such as different lengths from each other). This allows different brightness levels for a pixel 140 to be expressed by driving the pixel 140 with the first data signal (emission) for those subframe periods whose total lengths (e.g., sum of their lengths) correspond to the brightness of the pixel 140 for the frame, and driving the pixels 140 with the second data signal (non-emission) for the other subframe periods of the frame, each such data signal corresponding to a subframe period and synchronized with the non-sequentially supplied scan signal. For instance, the lengths of the different subframe periods may include two or more different lengths.

For example, when assuming that the number of subframes included in one frame is 5, the data driver 120 may supply the first and second data signals for combinations of subframe periods having two or more different lengths during a frame period in which the scan signal is supplied five times to each pixel 140 (or each horizontal line of pixels 140). This will be described in further detail corresponding to example driving methods according to embodiments of the present invention.

The display unit 130 receives power from first and second power sources ELVDD and ELVSS (such as first power ELVDD and second power ELVSS) supplied from outside thereof, and supplies the received first and second powers ELVDD and ELVSS to each pixel 140. Each pixel 140 implements a set or predetermined gray level by supplying current to an organic light emitting diode (OLED), corresponding to the first data signal (emission), for some combination of subframe periods, and not supplying current, corresponding to the second data signal (non-emission) for remaining ones of the subframe periods. According to embodiments of the present invention, the pixels 140 may be implemented, for example, with any one of various types of circuits currently known in the art, corresponding to a digital driving method.

Figure 2:
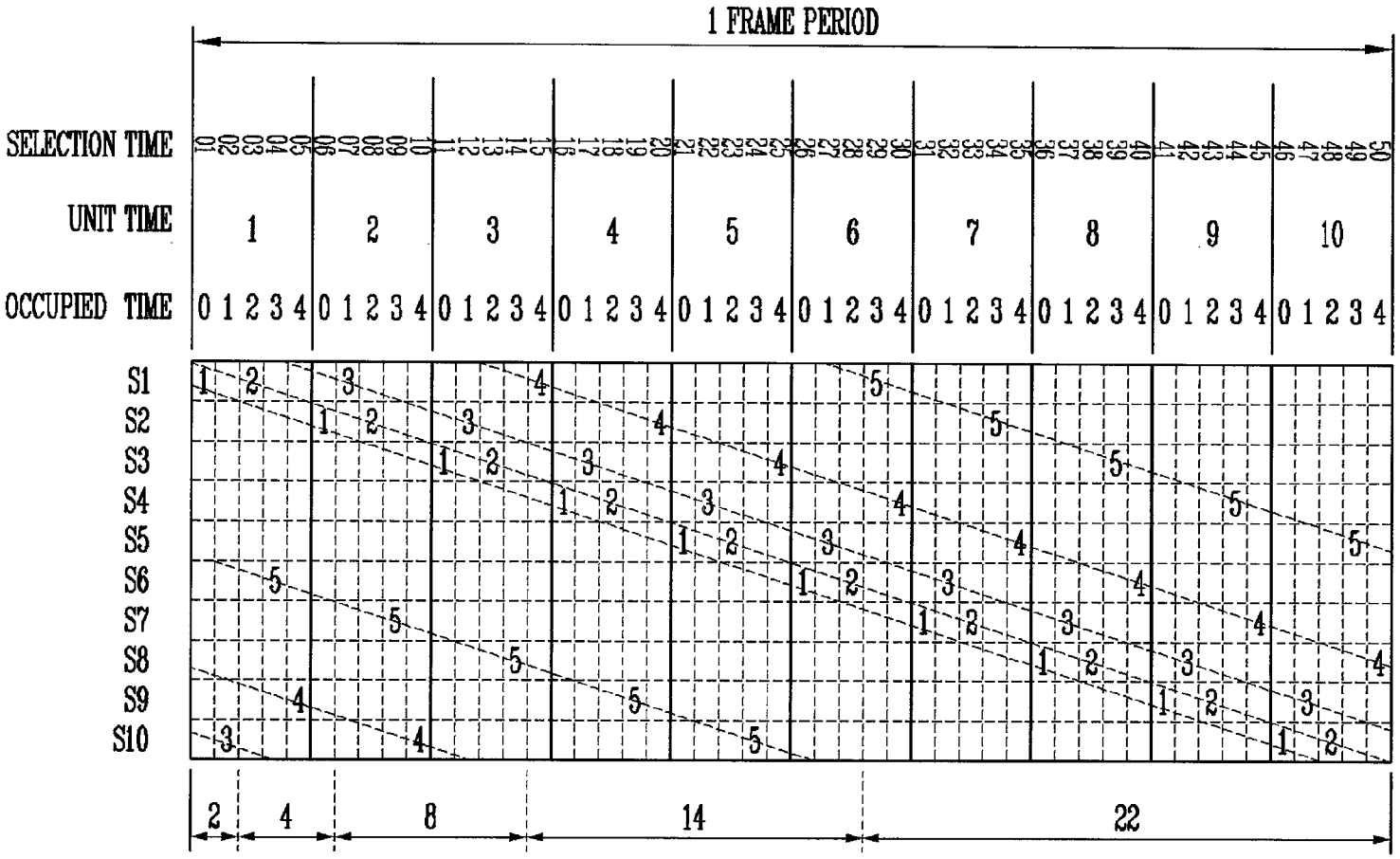
FIG. 2 is a diagram illustrating a digital diving method according to an embodiment of the present invention.

FIG. 2 is a diagram illustrating a digital diving method according to an embodiment of the present invention. For convenience of illustration, it is assumed that ten scan lines S1 to S10 are in the display unit 130. In other embodiments, different numbers of scan lines may be in the display unit 130, and a similar technique may be employed as would be apparent to one of ordinary skill.

In FIG. 2, the term 'selection time' means a selection time or unit time having a base or minimum length. A scan signal for one of the subframe periods is supplied to one of the scan lines every selection time. Accordingly, the number of selection times in one frame may be set by multiplying the number of subframes included in one frame by the number of scan lines. For example, as shown in FIG. 2, ten scan lines S1 to S10 are included in the display unit 130. Thus, when one frame is divided into five subframes (supplying data signals during five corresponding subframe periods having five different lengths), 50 selection times may be included in the one frame. Further, in one or more embodiments, such as the embodiment of FIG. 2, the total length of time of the five subframe periods also adds up to the same number of (in this case, 50) selection times.

Figure 3:
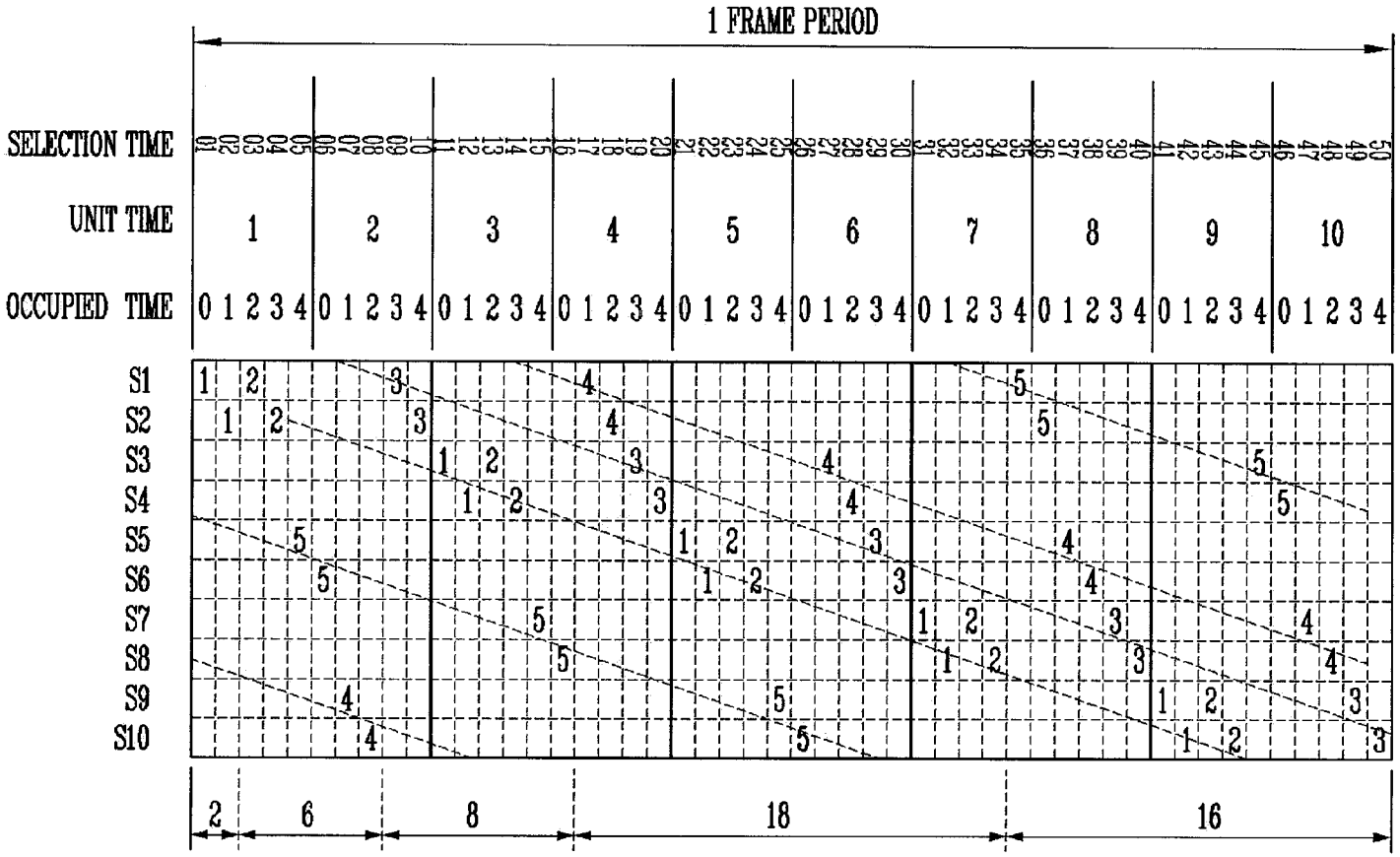
FIG. 3 is a diagram illustrating a digital diving method according to another embodiment of the present invention.
Figure 4:
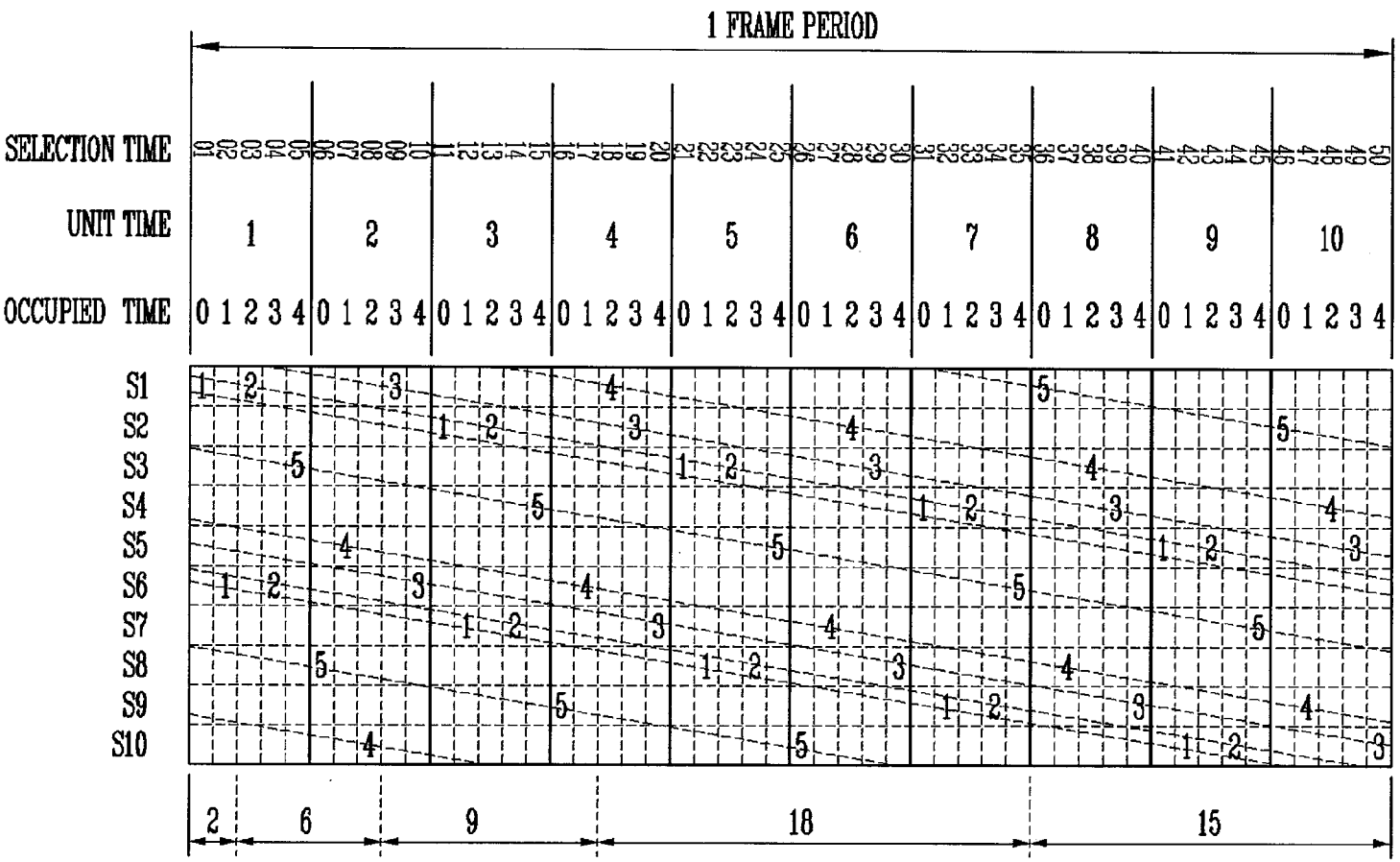
FIG. 4 is a diagram illustrating a digital diving method according to still another embodiment of the present invention.

The term 'unit time' is a time obtained by dividing one frame into a number of unit times, based on a control unit (such as a pattern for starting particular subframe periods for particular scan lines), as will become more apparent from examples illustrated in FIG. 2 to FIG. 4. For instance, as illustrated in FIG. 2, the unit time may be set to include as many selection times as the number of subframes included in one frame. For example, when five subframes are included in one frame, five selection times may be set to one unit time.

In FIG. 2, during the unit time, data signals corresponding to subframe periods having different lengths are supplied to be synchronized with the scan signal. For example, in FIG. 2, during each unit time, data signals are supplied in synchronization with the scan signal to correspond to the beginning of five separate subframe periods (denoted "1", "2", "3", "4", and "5"), usually for different horizontal or scan lines, and having corresponding lengths of 2, 4, 8, 14, and 22 selection times, respectively.

The term 'occupied time' is also included in each unit time (e.g., five selection times in FIG. 2), and refers to a time (such as a selection time) when a digital data signal is supplied to a data line. For example, in FIG. 2, with five selection times in each unit time, the occupied times in each unit time are denoted "0", "1", "2", "3", and "4". Thus, during occupied time 0 of unit time 1, the scan signal is supplied to the first scan line S1 while data signals are supplied to the pixels 140 of the first horizontal line corresponding to the first ("1") subframe period, which has a corresponding length of two selection times. In a similar fashion, during occupied time 1 of unit time 1, the scan signal is supplied to the tenth scan line S10 while data signals are supplied to the pixels 140 of the tenth horizontal line corresponding to the third ("3") subframe period, which has a corresponding length of eight selection times.

In one or more embodiments of the present invention, such as in FIG. 2, the scan signal is non-sequentially supplied to the scan lines during the unit time. For example, in FIG. 2, the scan signal is supplied to the first, tenth, first, sixth, and ninth scan lines S1, S10, S1, S6, and S9 during a first unit time. In addition, data signals corresponding to subframe periods having different lengths are supplied corresponding to the scan signal non-sequentially supplied to the scan lines during the unit time.

For example, in FIG. 2, data signals for subframe periods "1", "3", "2", "5", and "4" and having different lengths of 2, 8, 4, 22, and 14 selection times, respectively (i.e., data signals corresponding to subframe periods having different emission times, corresponding to the five subframes) may be sequentially supplied to be synchronized with the corresponding five scan signals during the unit time. Here, the length refers to an amount of time when the corresponding pixels 140 of the selected horizontal line emit (or do not emit) light.

For example, when the data signal for the first subframe "1" and having a length of 2 selection times is supplied, the corresponding pixels 140 emit (or do not emit) light during two consecutive selection times. When the data signal for the second subframe "2" and having a length of 4 selection times is supplied, the corresponding pixels 140 emit (or do not emit) light during four consecutive selection times.

In addition, the corresponding pixels 140 emit (or do not emit) light during eight consecutive selection times, corresponding to the data signal for the third subframe "3". The corresponding pixels 140 emit (or do not emit) light during fourteen consecutive selection times, corresponding to the data signal for the fourth subframe "4". The corresponding pixels 140 emit (or do not emit) light during twenty-two consecutive selection times, corresponding to the data signal for the fifth subframe "5".

In the embodiment of FIG. 2, using different combinations of subframe periods for emission, every combination of even number of selections can be obtained between 0 (no emission) and 50 (full emission, corresponding to the entire frame). That is, 26 possible lengths of emission times (gray levels), evenly spaced, can be obtained from the different combinations of subframe period emission in FIG. 2, thus providing good gray level expression performance.

Meanwhile, in one or more embodiments of the present invention, the time when the pixel 140 emits light, corresponding to a specific length (of selection times) or emission time each frame, may be variously set. That is, in one or more embodiments of the present invention, the scan signal is supplied to one scan line for a particular subframe during a selection time, and the emission time of the pixel 140 corresponding to the length of the subframe is controlled. Accordingly, subframe periods of different subframes may be variously set so that data signals having each of the different lengths can be supplied during the unit time.

Further, in the example embodiment of FIG. 2, the scan signal is sequentially supplied based on the unit time. That is, with each increase by 1 in unit time, the scan line receiving the scan signal increases by 1 (e.g., the scan signal for the first scan line S1 moves to the second scan line S2, the scan signal for the second scan line S2 moves to the third scan line S3, and so on, with the scan signal for the tenth scan line S10 moving back to the first scan line S1). For example, when the scan signal is supplied to the first scan line S1 during a zeroth occupied time of the first unit time, the scan signal is supplied to the second scan line S2 during a zeroth occupied time of a second unit time.

In the embodiment of FIG. 2, since data signals for subframe periods having different lengths are supplied corresponding to the scan signal non-sequentially supplied during the unit time (for example, the data signals for the zeroth occupied time of the first unit time corresponds to subframe period "1" of the first scan line S1, which are not likely to have much correlation to the data signals for the first occupied time of the first unit time, which correspond to subframe period "3" of the tenth scan line S10), and therefore, power consumption may be increased because of the relatively larger number of data lines that have to supply different data signals between consecutive occupied times.

In other words, consecutive scan signals supplied during the unit time select different sets of pixels for different subframes and usually with one or more horizontal lines interposed therebetween, which leads to little correlation between consecutive data signals to the same data line. For example, data signals for subframe periods having different lengths are consecutively supplied to be synchronized with the scan signal. This increases the likelihood that consecutive data signals (emission or non-emission) having different voltages will be supplied to the same data line. Therefore, the power consumption may be increased by the frequent charging/discharging of the data line. Accordingly, in the driving method shown in FIG. 3, another embodiment is described, this time where the power consumption may be reduced or minimized.

FIG. 3 is a diagram illustrating a digital diving method according to another embodiment of the present invention. In FIG. 3, detailed descriptions of components similar or identical to those of FIG. 2 may not be repeated.

Referring to FIG. 3, in this embodiment, a scan signal is non-sequentially supplied to the scan lines during portions of the unit time. In addition, data signals for subframe periods having two or more different lengths are supplied to be synchronized with the scan signal during the unit time. Unlike the embodiment of FIG. 2, where the driving pattern repeats every unit time (on different sets of scan lines), in FIG. 3, the driving pattern repeats every two unit times. That is, pairs of unit times (1 and 2, 3 and 4, . . . 9 and 10) have repeating driving patterns (on different sets of scan lines). In addition, in FIG. 3, the five subframe periods "1", "2", "3", "4", and "5" have corresponding lengths of 2, 6, 8, 18, and 16 selection times, respectively.

Here, to increase the correlation that consecutive data signals applied to the same data line represent the same data signal (and thus decrease power consumption), the scan signal is consecutively (e.g., sequentially) supplied to i (i is a natural number of 2 or more) scan lines adjacent to each other, and data signals from subframe periods having the same length are supplied to corresponding pixels 140 of the adjacent horizontal lines corresponding to the consecutively supplied scan signal. As such, the scan signal is consecutively supplied to the i scan lines adjacent to each other, and the data signals from subframe periods having the same length are supplied to the corresponding pixels 140 of the adjacent horizontal lines corresponding to the consecutively supplied scan signal, thereby reducing power consumption.

In other words, when the data signals from subframe periods having the same length are supplied corresponding to the consecutively supplied scan signal (e.g., for portions of the scan signal that are sequentially applied to adjacent scan lines), it is more likely that data signals having the same voltage (emission or non-emission) will be consecutively supplied to the same data line, thereby reducing power consumption. That is, when the same data signal corresponding to the continuous emission (or non-emission) of pixels is supplied to the same data line as the data signal, the charging/discharging in the data line is lessened or minimized, thereby reducing power consumption.

In FIG. 3, the scan signal is sequentially supplied at times to the i scan lines, while data signals from subframe periods having lengths corresponding to the five subframes are supplied during pairs of the unit times. When data signals from subframe periods having the same length are supplied corresponding to the scan signal supplied to two adjacent scan lines, the scan signal is sequentially supplied based on two unit times (e.g., the pattern repeats every two unit times, only on different pairs of adjacent scan lines). For example, when the scan signal is supplied to the first and second scan lines S1 and S2 during zeroth and first occupied times of the first unit time, the scan signal is supplied to the third and fourth scan lines S3 and S4 during zeroth and first occupied times of the third unit time.

When the scan signal is sequentially supplied to the i scan lines adjacent to each other during the unit time, the gray level expression performance may be partially deteriorated. For example, in FIG. 3, the emission times of the five subframes are 2, 6, 8, 18, and 16 selection times. Therefore, unlike FIG. 2, where the lengths of the five subframe periods are 2, 4, 8, 14, and 22 selection times, which allows every even emission length (gray level) between 0 and 50 selection times to be generated from combinations of the five subframes, in FIG. 3, even emission lengths of 4, 12, 38, and 46 selection times cannot be generated from a combination of the five subframe periods (thus degrading gray level expression performance from that of FIG. 2).

Accordingly, the driving method of FIG. 3 may be more applicable to special situations where a large amount of power consumption is required. Further, although the gray scale expression performance is partially deteriorated, the driving method of FIG. 3 can be applied to portable devices and the like so that the power consumption is improved.

Additionally, the number of scan lines i to which the scan signal is consecutively supplied to adjacent scan lines to lessen or minimize the deterioration of the gray level expression performance is set to a number smaller than the number of subframes j included in one frame (i.e., i is set to a number smaller than j). For instance, as in FIG. 3, setting i=2 causes subframe periods to be even lengths (of selection times), which is not very significant to gray level expression performance, while setting i=5 causes subframe periods to be multiples of five selection times, which significantly impacts the number of gray levels that can be expressed between 0 and 50 selection times (i.e., the length of one frame).

That is, in this (FIG. 3) or similar embodiments, data signals for subframe periods having the same length are supplied to be synchronized with the scan signal supplied to scan lines having a number i no less than two and smaller than that of the number of subframes j, thereby reducing power consumption, and without significantly deteriorating gray level expression performance.

FIG. 4 is a diagram illustrating a digital diving method according to still another embodiment of the present invention. In FIG. 4, detailed descriptions of components similar or identical to those of FIG. 2 or FIG. 3 may not be repeated.

Referring to FIG. 4, in this embodiment, a scan signal is non-sequentially supplied to the scan lines during the unit time (that is, consecutive scan signals are supplied to non-adjacent scan lines). In addition, data signals for subframe periods having two or more different lengths are supplied to be synchronized with the scan signal during the unit time.

Here, as in FIG. 3, the scan lines S1 to S10 are divided by i (such as i=2) to be driven in groups of i scan lines. For example, a scan signal is supplied to a specific scan line during the unit time, and subsequently supplied to another scan line distant from the specific scan line by a number of lines obtained by multiplying the total number of the scan lines by 1/i (e.g., i=2 in FIG. 3 and FIG. 4). That is, scan lines in each group of i scan lines are spaced apart from each other by the total number of scan lines divided by i. For instance, in FIG. 4, with ten scan lines S1 to S10 and i=2, there are five groups of two scan lines each, and the number of scan lines between scan signals in each group of two scan lines is five (e.g., if the first scan line S1 is driven during one selection time in a group, then the sixth scan line S6 is driven during the next selection time of the group).

In addition, data signals for subframe periods having the same length are supplied corresponding to the scan signal supplied to the i scan lines in the group. Here, as in FIG. 3, consecutive groups of i data signals to each data line are for subframe periods having the same length, and thus are more likely to be set to the same voltage, thereby reducing power consumption. In other words, a scan signal is consecutively supplied to a group of i scan lines, and data signals for subframe periods having the same length are supplied corresponding to the consecutively supplied scan signals, thereby reducing power consumption.

When groups of i scan lines consecutively receiving the scan signal are distant from each other by the number of the scan lines divided by i, data signals for subframe periods having lengths corresponding to five subframes are supplied during i unit times. In addition, when the scan lines consecutively receiving the scan signal are spaced apart from each other by the number lines obtained by dividing the number of the scan lines by i, the scan signal is sequentially supplied to adjacent scan lines based on periods of i unit times. For example, in FIG. 4, when i is set to 2, and the scan signal is supplied to the first and sixth scan lines S1 and S6 during zeroth and first occupied times of a first unit time, the scan signal is supplied to the second and seventh scan lines S2 and S7 during zeroth and first occupied times of a third unit time.

In the aforementioned description, the scan signal is sequentially supplied to scan lines distant from each other by the number of lines obtained by multiplying the number of the scan lines by 1/i. Here, as in FIG. 3, i is set to a number smaller than the number of subframes j (e.g., 5) included in one frame so that the deterioration of the gray scale expression performance is minimized.

For example, in FIG. 4, the five subframe periods have corresponding lengths of 2, 6, 9, 18, and 15 selection times, which allows 26 different emission time lengths (gray levels) to be expressed between 0 and 50 selection times from the different combinations of subframe periods. While this is as many different gray levels as there are in FIG. 2, the embodiment of FIG. 4 includes some emission times of odd length and (like FIG. 3) has four gaps of four selection times (i.e., between 2 and 6, between 11 and 15, between 35 and 39, and between 44 and 48 selection times) that are not expressible using combinations of the five subframe periods.

Accordingly, like FIG. 3, the driving method of FIG. 4 may be particularly applicable to special patterns where a large amount of power consumption is required. For example, when this driving method is applied to a pattern where black and white are repeated for each line, it is possible to reduce or minimize power consumption in charging/discharging of the data line.

By way of summation and review, an organic light emitting display may be driven, for example, by an analog driving method or a digital driving method. In the analog driving method, gray levels are implemented using voltage differences in the data signals to produce different brightness levels that are emitted for the same period of time. By contrast, in the digital driving method, gray levels are implemented using emission time differences of the same emission intensity to produce different brightness levels.

In the analog driving method, different data voltages are respectively applied to pixels, thereby implementing different gray levels. That is, in the analog driving method, a data voltage corresponding to each gray level is generated, and the luminance of the pixels is controlled corresponding to the generated data voltages, so that data voltages having a plurality of levels corresponding to the number of gray levels are necessarily generated. However, in the analog driving method, a difference in luminance occurs even when the same data voltage is supplied to different pixels due to a difference in characteristics between the pixels. Therefore, it is difficult to consistently express an exact gray level.

On the other hand, in the digital driving method, the emission time and non-emission time of each pixel, i.e., the display period of each pixel is controlled, thereby implementing gray levels. In the digital driving method, it is easier to consistently express exact gray levels in the organic light emitting display, etc., than with the analog driving method. Thus, the digital driving method of expressing gray levels by adjusting the emission time of each pixel has recently been widely applied.

However, in the digital driving method, the gray levels are expressed by repeatedly charging/discharging data lines and capacitors in the pixels at a high frequency, and hence power consumption may be increased. Particularly, as a display panel becomes large in size and high in resolution, the number of lines to be driven increases, and the driving frequency increases. Hence, the increase in power consumption may become noticeable or serious. Therefore, it may be desired to implement a display device using the digital driving method while reducing power consumption.

In the organic light emitting display and the driving method of the organic light emitting display according to embodiments of the present invention, data signals for subframe periods having the same length are consecutively supplied during one unit time. In a display device driving by the digital driving method, there is more likelihood that the data signals for subframes having the same length will be set to the same data signal (e.g., emission or non-emission), thereby reducing or minimizing power consumption.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. A method of driving an organic light emitting display, the method comprising:

setting a number of selection times constituting one frame; and setting a number of unit times constituting the one frame, each of the unit times including j (j is a natural number of 2 or more) of the selection times, wherein scan signals are non-sequentially supplied to scan lines during each of the unit times, the one frame comprises a number of subframes, and wherein, in the one frame, for each one of the subframes, data signals for all ones of the subframes having a same length as each one of the subframes are supplied corresponding to consecutive ones of the scan signals supplied during i (i is a natural number of 2 or more) consecutive ones of the selection times.

2. The method of claim 1, wherein data signals for ones of the subframes having two or more lengths are supplied during each of the unit times.

3. The method of claim 1, wherein each of the selection times is a time when one of the scan signals is supplied to one of the scan lines.

4. The method of claim 1, wherein the number of selection times constituting the one frame equals the number of subframes constituting the one frame times a number of the scan lines.

5. The method of claim 1, wherein j is the number of subframes constituting the one frame.

6. The method of claim 5, wherein i is smaller than j.

7. The method of claim 1, wherein ones of the scan lines corresponding to the i consecutive ones of the scan signals are adjacent to each other.

8. The method of claim 1, wherein ones of the scan lines corresponding to the i consecutive ones of the scan signals are spaced apart from each other by a number of the scan lines divided by i.

9. The method of claim 1, wherein the subframes constituting the one frame have two or more lengths, and data signals for the subframes having all of the lengths are supplied during i consecutive ones of the unit times.

10. The method of claim 1, wherein each of the data signals is a first data signal corresponding to emission of a pixel or a second data signal corresponding to non-emission of the pixel.

11. An organic light emitting display in which one frame includes j (j is a natural number of 2 or more) subframes, the organic light emitting display having unit times each including j selection times when scan signals are supplied, the organic light emitting display comprising:

pixels at crossing regions of scan lines and data lines;

a scan driver configured to non-sequentially supply the scan signals to the scan lines for each of the unit times; and a data driver configured to supply, in the one frame, for each one of the subframes, data signals to the data lines for all ones of the subframes having a same length as each one of the subframes, corresponding to consecutive ones of the scan signals supplied during i (i is a natural number of 2 or more) consecutive ones of the selection times.

12. The organic light emitting display of claim 11, wherein the data driver is further configured to supply data signals for ones of the subframes having two or more lengths during each of the unit times.

13. The organic light emitting display of claim 11, wherein a number of the selection times constituting the one frame equals the number of the scan lines times j.

14. The organic light emitting display of claim 11, wherein i is smaller than j.

15. The organic light emitting display of claim 11, wherein ones of the scan lines corresponding to the i consecutive ones of the scan signals are adjacent to each other.

16. The organic light emitting display of claim 11, wherein ones of the scan lines corresponding to the i consecutive ones of the scan signals are spaced apart from each other by a number of the scan lines divided by i.

17. The organic light emitting display of claim 11, wherein each of the data signals is a first data signal corresponding to emission of one of the pixels or a second data signal corresponding to non-emission of the one of the pixels.

* * * * *